US010674254B1

(12) United States Patent
Cater et al.

(10) Patent No.: US 10,674,254 B1
(45) Date of Patent: Jun. 2, 2020

(54) AUDIBLE DISTORTION REDUCING FIN ELEMENT

(71) Applicant: Apple Inc., Cupertino, CA (US)

(72) Inventors: Tyler B. Cater, San Jose, CA (US); Mu-Hua Cheng, Mountain View, CA (US); Teemu P. Sipila, Campbell, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/372,308

(22) Filed: Apr. 1, 2019

(51) Int. Cl.
*H04R 1/28* (2006.01)
*H04R 1/02* (2006.01)

(52) U.S. Cl.
CPC ..... *H04R 1/2888* (2013.01); *H04R 1/025* (2013.01); *H04R 2499/11* (2013.01)

(58) Field of Classification Search
CPC ..... H04R 1/28; H04R 1/2803; H04R 1/2823; H04R 1/2826; H04R 1/2846; H04R 1/2849; H04R 1/2853; H04R 1/2888; H04R 2499/11
See application file for complete search history.

(56) References Cited

U.S. PATENT DOCUMENTS

| | | | | |
|---|---|---|---|---|
| 6,171,357 | B1 * | 1/2001 | Guttmann | B01D 46/10 55/385.7 |
| 6,508,704 | B1 * | 1/2003 | Wilson | F24F 13/082 454/277 |
| 8,687,828 | B2 | 4/2014 | Otani et al. | |
| 9,693,134 | B2 | 6/2017 | Karube et al. | |
| 2002/0003888 | A1 * | 1/2002 | Budge | H04R 1/2888 381/345 |

FOREIGN PATENT DOCUMENTS

| | | |
|---|---|---|
| CN | 204616050 U | 9/2015 |
| GB | 2310559 A | 8/1997 |

* cited by examiner

*Primary Examiner* — Walter F Briney, III
(74) *Attorney, Agent, or Firm* — Dorsey & Whitney LLP

(57) ABSTRACT

A portable electronic device includes a housing that at least partially defines an internal volume. The portable electronic device further includes a cover secured to the housing and that is and capable of enclosing the internal volume. The cover having a cover opening capable of passing an audible sound provided by an audio module located within the internal volume. The audible sound passing from the audio module to the cover opening along an audible sound path. The portable electronic device further includes a bracket assembly positioned in the internal volume and having: (i) a bracket opening that is aligned with and between the audio module with the cover opening, and (ii) a fin element that spans the bracket opening, the fin element having at least a portion positioned within the audible sound path.

20 Claims, 8 Drawing Sheets

AUDIBLE DISTORTION REDUCING FIN ELEMENT

FIELD

The following description relates to an electronic device. In particular, the following description relates to a portable electronic device having an audio module capable of providing audible sound that can be ported through an opening.

BACKGROUND

Portable electronic devices can include an internal volume that houses an audio module. The audio module can be capable of emitting an audible sound through an opening in a cover enclosing the internal volume. For example, when the portable electronic device is a smartphone, the audio module can play music and/or emit a voice of a person participating in a telephone call with a user of the smartphone. The audible sound can be ported through the opening in the cover of the portable electronic device such that people within a certain range of the portable electronic device can hear the audible sound.

SUMMARY

In one aspect, a portable electronic device is described. The portable electronic device may include a housing that at least partially defines an internal volume. The portable electronic device may further include a cover secured to the housing and that is and capable of enclosing the internal volume. The cover may have a cover opening capable of passing an audible sound provided by an audio module located within the internal volume. The audible sound may pass from the audio module to the cover opening along an audible sound path. The portable electronic device may further include a bracket assembly positioned in the internal volume and may have: (i) a bracket opening that is aligned with and between the audio module with the cover opening, and (ii) a fin element that spans the bracket opening, the fin element having at least a portion positioned within the audible sound path.

In another aspect, a portable electronic device is described. The portable electronic device may include an enclosure having a bottom wall and side walls. The portable electronic device may further include a cover secured to the enclosure, where the bottom wall, side walls, and cover combine to at least partially define an internal volume. The cover may have a cover opening. The portable electronic device may further include an audio module disposed in the internal volume and capable of providing an audio energy flow, the audio energy flow passing from the audio module to the cover opening along an audio energy flow path. The portable electronic device may further include an acoustic element disposed within the audio energy path and capable of interaction with the audio energy flow to reduce an audible distortion at the cover opening.

In another aspect, a portable electronic device is described. The portable electronic device may include an enclosure defined by side walls, a bottom wall, and a cover with a cover opening. The portable electronic device may also include an audio module disposed in the enclosure. The audio module capable of producing audible sound along a flow path through the enclosure to the cover opening. The portable electronic device may also include a set of fin elements disposed in the enclosure such that the set of fin elements are each located in the flow path of the audible sound as the audible sound travels from the audio module to the cover opening.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
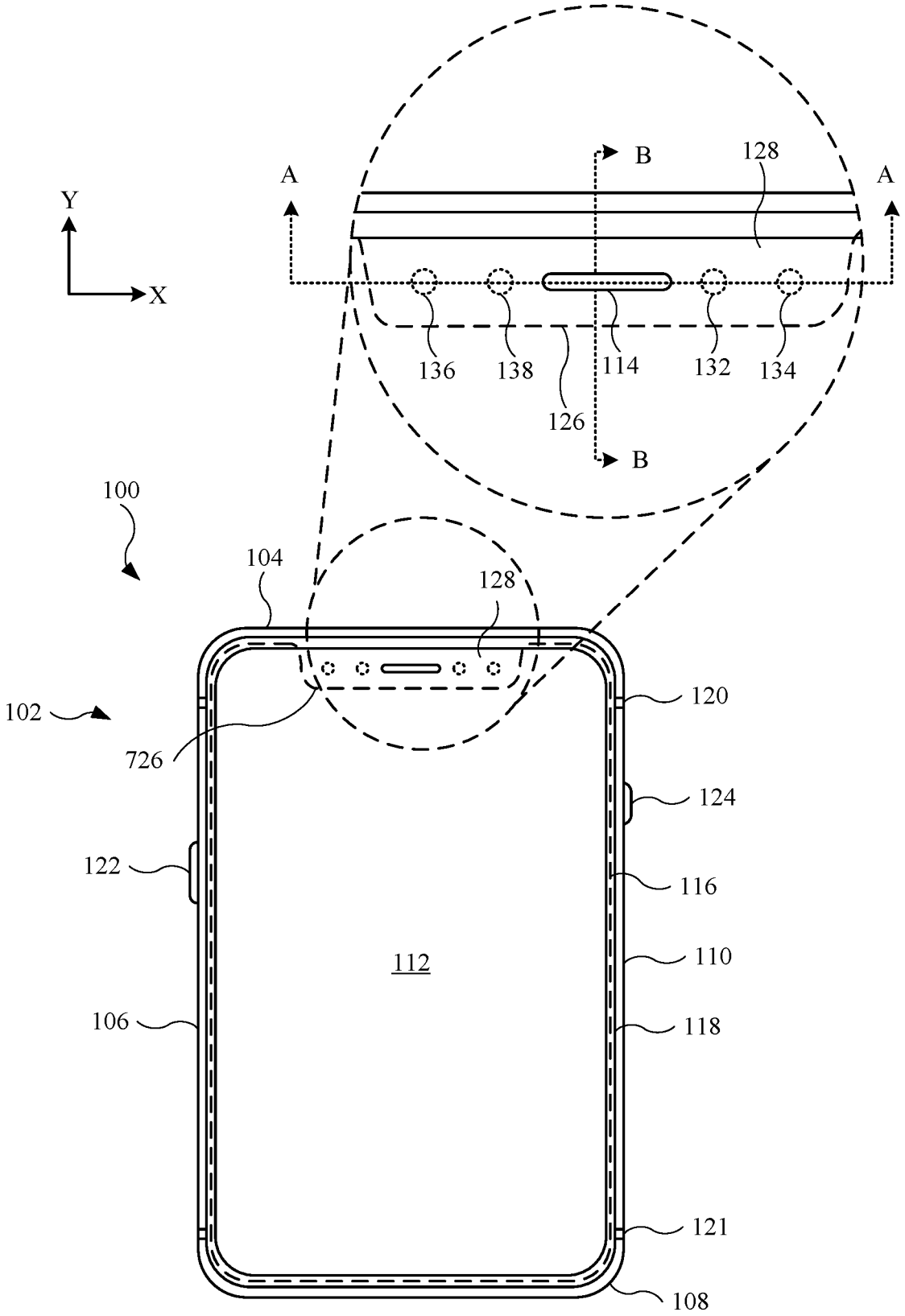
FIG. 1 illustrates a plan view of an embodiment of an electronic device including a fin element, in accordance with some described embodiments.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present techniques described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

Portable electronic devices may include an audio module and other structures relative to the audio module within an internal volume of the portable electronic devices. An example of such a portable electronic device may include a smartphone (e.g., iPhone® manufactured by Apple Inc. of Cupertino, Calif.), a tablet, a laptop, or any suitable portable electronic device. When the audio module emits audible sound (also referred to as an audio energy flow herein), the structures may vibrate and cause a non-laminar or turbulent flow of the audible sound that results in acoustic distortion as the audible sound traverses an audio energy flow path between the audio module and an opening through which the audible sound is ported. The other structures relative to the audio module that vibrate may include support structures, sub-assembly structures, covering structures, alignment structures, bracket structures, receiver structures, and/or other modules (e.g., vision system, microphone, lighting, etc.). As the other structures vibrate, they may contact one another, which further exacerbates the acoustic distortion. The other structures may provide a tortuous path for the audible sound to traverse when being emitted. Air associated with the audible sound may contact the other structures in the tortuous path, which may cause the other structures to vibrate. The acoustic distortions that are produced in the audible sound may provide for lower quality audio.

Accordingly, some embodiments of the present disclosure relate to a portable electronic device that includes a fin element or acoustic element disposed in the internal volume of the portable electronic device between the audio module and the opening or acoustic aperture of the portable electronic device through which audio emitted by the audio module is ported. Adding the fin element to the acoustic aperture laminarizes the flow and reduces rub and buzz noise at the cover opening. In some embodiments, more than one fin element may be disposed in the internal volume to further reduce the acoustic distortion. The fin element may be disposed in any suitable location in the internal volume that is in the flow path of the air associated with the audible sound. By being placed in the flow path, the fin element may disrupt turbulence of the air carrying the audible sound and reduce the acoustic distortion of the audible sound at the opening by re-laminarizing the flow of the audible sound. The audible sound that emanates from the opening of the portable electronic device may include reduced acoustic distortion that provides for higher quality audio for audio emitted out of small and/or offset openings.

In some embodiments, the portable electronic device may include a housing having a bottom wall and side walls that combine to at least partially define an internal volume. The portable electronic device may also include a cover secured to the side walls and that is and capable of enclosing the internal volume. The cover may include a cover opening capable of porting the audible sound provided by the audio module located in the internal volume. In some embodiments, the portable electronic device may include a bracket assembly positioned in the internal volume and having (i) a bracket opening that is aligned with and between the audio module with the cover opening, and (ii) the fin element. The fin element may span the bracket opening and at least a portion of the fin element may be in a flow path of the audible sound. In some embodiments, the fin element may be installed in an alignment module of the bracket assembly. Further, the audio module may be installed in a receiver of the alignment module. The alignment module may align the audio module with the cover opening such that the audible sound may be ported out of the portable electronic device via the cover opening. Additional modules may be installed in the bracket assembly and/or the alignment module, such as a vision system, a microphone, a lighting module, or the like.

In some embodiments, the fin element may block a portion of the bracket opening to cause the audible sound to flow around the portion of the bracket opening occupied by the fin element. Disrupting the flow path of the audible sound may cause the flow to be re-laminarized. The size of the fin element may balance acoustic resistance with laminarization efficacy. The width of the fin element (e.g., 0.05 millimeters (mm) to 0.15 mm) may be less than the width of the bracket opening (e.g., 0.4 mm to 0.6 mm) such that the audible sound is not forced through too constricted of spaces. Further, the fin element may be any suitable shape. For example, the fin element may include one or more flat surfaces, one or more surfaces with a peak, one or more surfaces with a valley, or some combination thereof. The fin element may be made of any suitable material (e.g., polycarbonate, metal (stainless steel, aluminum, etc.), etc.).

The fin element may be rigidly-attached or non-rigidly attached to any suitable portion of the internal volume that is in the flow path of the audible sound. Rigidly attached may refer to the fin element being integral with another portion (e.g., included as part of the mold of another portion) or welded onto another portion. Non-rigidly attached may refer to being attached with an adhesive (e.g., glue, tape, etc.). For example, the fin element may be rigidly-attached to the bracket assembly or the alignment module by being included in a mold of the bracket assembly or the alignment module, or by being welded to the bracket assembly or the alignment module. The fin element may be rigidly-attached to a receiver housing the audio module. The fin element may be non-rigidly attached to any suitable portion of the bracket assembly or the alignment module by using an adhesive (e.g., glue, tape).

In some embodiments, a cosmetic mesh may cover the cover opening of the portable electronic device. The cosmetic mesh may reduce the visibility of components that are located in a portion of the internal volume aligned with the cover opening. The fin element may be one such component that is located in the portion of the internal volume. In some instances, light may reflect off of the various components and cause the visibility of the components to increase. In some embodiments, various features may be included on a surface of the fin element facing the cover opening to reduce the light reflections. Example features may include laser markings, dark ink coloring, polyurethane coating, an offset pyramid geometry, peaks and valleys of the offset pyramid geometry that are laser-etched, or some combination thereof. The features may reduce different kinds of light reflection. As a result of including the features on the surface of the fin element facing the cosmetic mesh, light reflecting off of the fin element may be reduced, thereby reducing the visibility of the fin element through the cosmetic mesh.

These and other embodiments are discussed below with reference to FIGS. 1-12. However, those skilled in the art will readily appreciate that the detailed description given herein with respect to these Figures is for explanatory purposes only and should not be construed as limiting.

FIG. 1 illustrates a plan view of an embodiment of an electronic device 100, in accordance with some described embodiments. In some embodiments, the electronic device 100 is a tablet computing device. In other embodiments, the electronic device 100 is a wearable electronic device. In the embodiment shown in FIG. 1, the electronic device 100 is a portable electronic device, commonly referred to as a smartphone. It should be understood that electronic device 100 and portable electronic device 100 may be used interchangeably herein. The electronic device 100 may include an enclosure 102 that includes a bottom wall (not shown) and several side wall components, such as a first side wall component 104, a second side wall component 106, a third side wall component 108, and a fourth side wall component 110. The side wall components may combine with the bottom wall to define an internal volume, or cavity, to hold the internal components of the electronic device 100. In some embodiments, the bottom wall includes a non-metal, such as glass, plastic, or other transparent material. Also, in some embodiments, the first side wall component 104, the second side wall component 106, the third side wall component 108, and the fourth side wall component 110 include a metal, such as steel (including stainless steel), aluminum, or an alloy that includes aluminum and/or steel. Further, each of the aforementioned side wall components may be separated and isolated from each other by a filler material that includes a non-metal such that the side wall components are electrically isolated from each other. For example, the enclosure 102 may include a first filler material 120 that separates the first side wall component 104 from the second side wall component 106 and the fourth side wall component 110. The enclosure 102 may further include a second filler material 121 that separates the third side wall component 108 from the second side wall component 106 and the fourth side wall component 110. The first filler material 120 and the second filler material 121 may include a molded plastic and/or a molded resin. In some instances, at least one of first filler material 120 and the second filler material 121 includes an antenna component (not shown in FIG. 1).

The electronic device 100 may further include a cover 112 that secures over the enclosure 102, and in particular, the aforementioned side wall components of the enclosure 102. In this regard, the first side wall component 104, the second side wall component 106, the third side wall component 108, and the fourth side wall component 110 may provide an edge region that defines an opening that receives the cover 112. The cover 112 may include a material such as glass or sapphire, or another suitable transparent material. When formed from glass, the cover 112 may be referred to as a cover glass. Also, the cover 112 may further include a cover opening 114, or though hole. The cover opening 114 is labeled in the enlarged view. The electronic device 100 may further include an audio module (for example, the audio module 200 shown in FIG. 2) aligned with the cover opening 114 in order to allow acoustical energy (e.g., an audible sound) generated from the audio module to exit the electronic device 100 via the cover opening 114. As described further below, the acoustical energy may be affected by acoustic distortion created as the audible sound flows through various structures in a tortuous path from the audio module to the cover opening 114. To reduce the acoustic distortion experienced by the audible sound, one or more fin elements (for example, the fin element 202 shown in FIG. 2) may be disposed in a flow path of the audible sound in the internal volume of the electronic device 100. The one or more fin elements may cause the audible sound to be re-laminarized, thereby reducing the acoustic distortion. The fin element is not illustrated in FIG. 1 because its visibility through the cover opening 114 may be reduced due to the one or more light reflecting, reducing features that are included in the fin element. Example locations, types, and/or characteristics of the one or more fin elements are discussed further below.

The electronic device 100 may further include a display assembly 116 (shown as a dotted line) that is covered or overlaid by the cover 112. Accordingly, the cover 112 may be referred to as a protective layer. The display assembly 116 may include multiple layers, with each layer serving one or more particular functions. The electronic device 100 may further include a display cover 118 that is covered by the cover 112 and defines a border around the display assembly 116. In particular, the display cover 118 may substantially cover an outer edge of the display assembly 116. The electronic device 100 may include control inputs. For example, the electronic device 100 may include a first button 122 and a second button 124, each of which is design to allow for a user input to control the display assembly 116. The first button 122 and/or the second button 124 may be used to actuate a switch (not shown in FIG. 1), thereby generating an input to a processor (not shown in FIG. 1).

As shown, the cover 112 may include a rectilinear design defined by the side wall components of the enclosure 102. However, in some instances, as shown in FIG. 1, the display assembly 116 (and at least some of its associated layers) may include a notch 126 formed in the display assembly 116. The notch 126 is also labeled in the enlarged view. The notch 726 may represent a reduced surface area of the display assembly 116 (as compared to that of the cover 112). The electronic device may include a masking layer 128 applied to the underside, or bottom surface, of the cover 112 in a location corresponding to the notch 126. The masking layer 128 may include an ink material (or materials) that provides an appearance (in terms of color) that is substantially similar to the appearance of the display assembly 116 (when the display assembly 116 is off). For example, both the masking layer 128 and the display assembly 116 may include a dark appearance that resembles black. Also, in some instances, the display cover 118 may include an appearance (in terms of color) that is similar to both the masking layer 128 and the display assembly 116 (when the display assembly 116 is off).

Generally, the masking layer 128 includes an opaque material that blocks the passage of light, and accordingly, may obscure vision into the electronic device 100. However, the masking layer 128 may include several openings that represent a void in the masking layer 128. For example, as shown in the enlarged view, the masking layer 128 may include a first opening 132 and a second opening 134. When the electronic device 100 includes a vision system, the camera modules may align with the first opening 132 and the second opening 134. The masking layer 128 may further include a third opening 136 and a fourth opening 138. Additional camera modules and/or lighting modules may align with the third opening 136 and the fourth opening 138. While the masking layer 128 is shown as having several openings, each of the openings may be filled with a material that provides at least some masking and/or some consistency in appearance (in terms of color). In this regard, the openings may be not be easily seen by a user, thereby hiding the sensor and the modules of the vision system, and the overall consistency of the electronic device 100 is at least partially maintained in terms of appearance. Also, as shown in the enlarged view, the first opening 132, the second opening 134, the third opening 136, and the fourth opening 138 may be centered with the masking layer 128 in both the X- and Y-dimensions.

Figure 2:
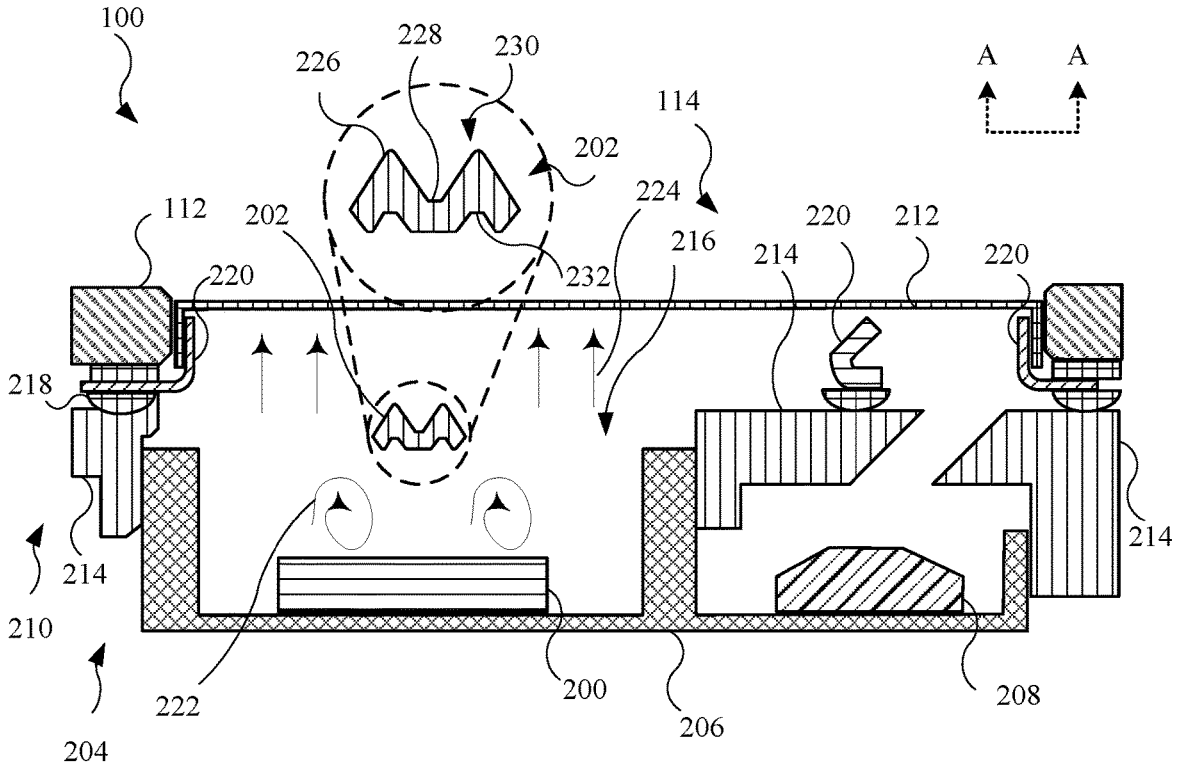
FIGS. 2-5 illustrate a cross sectional view taken along line A-A of FIG. 1 of examples of one or more fin elements disposed in an internal volume of a portable electronic device between a cover opening and an audio module, in accordance with some described embodiments.

FIGS. 2-5 illustrate a cross sectional view taken along line A-A of FIG. 1 of examples of one or more fin elements 202 disposed in an internal volume 204 of a portable electronic device 100 between a cover opening 114 and an audio module 200, in accordance with some described embodiments. For example, FIG. 2 illustrates a first example of the fin element 202 disposed in the internal volume 204. The internal volume 204 may be at least partially defined by the bottom wall and side walls of the portable electronic device 100. The cover 112 (e.g., where the masking layer 128 is located) may be secured to the side walls and that is and capable of enclosing the internal volume. As depicted, the cover 112 includes the cover opening 114. The cover opening 114 may be capable of porting an audible sound provided by the audio module 200 located within the internal volume 204.

The audio module 200 may be disposed in a receiver 206 in the internal volume 204. The receiver 206 may also house a microphone 208. The receiver 206 may be secured to an alignment module 210 that is capable of aligning the audio module 200 and/or the microphone 208 with the cover opening 114 to allow the audio module 200 and the microphone 208 to access the ambient environment. The alignment module 200 may be included in a bracket assembly that is capable of housing additional components (e.g., such as a vision system). The receiver 206 may house any other suitable elements (e.g., lighting elements), modules, and/or sensors. The audio module 200 and the microphone 208 may include any suitable features described herein for an audio module and a microphone. In order to hide the audio module 200 and the microphone 208 from view, a cosmetic mesh 212 may secure (by adhesives, for example) to the cover 112 and cover the cover opening 114, thereby covering the audio module 200 and the microphone 208. The cosmetic mesh 212 may include a material that permits acoustical energy to pass through the cosmetic mesh 212.

The alignment module 210 may include an alignment ring 214. The alignment ring 214 may include a bracket opening 216 or an alignment module opening 216 that is aligned with and between the audio module 200 and the cover opening 114 to allow audible sound to be ported from the audio module out of the cosmetic mesh 212. The receiver 206 may be rigidly or non-rigidly secured to the alignment ring 214. The alignment ring 214 may be secured to the cover 112 via an adhesive (e.g., glue or tape) 218. Further, a stiffener 220 may be disposed between the adhesive 218 and may be secured to the cosmetic mesh 212 via other adhesive or by any suitable technique. The stiffener 220 may be made of any suitable material to provide structural support, such as metal, plastic, etc. In some instances, when a fin element is not disposed in the flow path of the audible sound, the audible sound emitted by the audio module 200 and/or the audio module 200 bumping against the receiver as it emits the audible sound may cause the stiffener 220 to vibrate or resonate, which may lead to turbulent kinetic energy (acoustic distortion represented by squiggly circular arrows 222) in the audible sound. Further, the stiffener 220 may contact the cover 112 while the stiffener 220 is vibrating, which may cause the turbulent kinetic energy to be increased.

To reduce the acoustic distortion 222, in some embodiments, the fin element 202 may be disposed at any suitable location of the internal volume 204 that is in a flow path of the audible sound to cause the audible sound to re-laminarize (re-laminarized audible sound represented by straight arrows 224) prior to exiting the cosmetic mesh 212. Re-laminarize refers to causing the audible sound to have a laminar flow which exhibits less acoustic distortion than non-laminar flow. Laminar flow occurs in fluid dynamics when a fluid (e.g., audible sound) flows in parallel layers without disruption between the layers. Non-laminar flow occurs when the fluid does not flow in parallel layers and there is disruption between the layers, thereby causing acoustic distortion, for example. As depicted, the fin element 202 may be rigidly or non-rigidly (e.g., via an adhesive) installed in a portion of the bracket opening 216 or the alignment module opening 216 in such a way that the fin element 202 is in a flow path of audible sound emitted by the audio module 200. The fin element 202 may span the bracket opening 216 or the alignment module opening 216. Further, in some embodiments the fin element 202 may be substantially or completely centered in the bracket opening 216 or the alignment module opening 216. For example, the fin element 202 may be included as part of the mold of the alignment module 210 or may be welded to side walls of the alignment module opening 216. In some embodiments, an additional stiffener may be disposed in the internal volume 204 such that the additional stiffener is located above a portion of the alignment module opening 216, and the fin element 202 may be rigidly or non-rigidly attached to the additional stiffener at a location that is in the flow path of the audible sound emitted from the audio module 200. In some embodiments, the fin element 202 may be rigidly or non-rigidly attached to the receiver 206 at a location that is in the flow path of the audible sound emitted from the audio module 200.

As depicted in the enlarged view of the fin element 202, the fin element 202 may include one or more peaks 226 and one or more valleys 228 on a surface (top surface 230) of the fin element 202 facing the cosmetic mesh 212 and cover opening 114. The fin element 202 may be characterized as having a chevron like cross section. The peaks 226 and valleys 228 may provide light reflecting benefits to allow light that enters the cosmetic mesh 212 to be redirected or channeled in such a way that reflected light is reduced. For example, the top surface 230 may have an offset pyramid geometry, as described further below. Further, a surface (bottom surface) of the fin element 202 facing the audio module 200 may include one or more valleys 232 or indentions. The valleys 232 may enable light that enters a slope of one of the peaks 226 on the top surface to exit a slope of one of the valleys 232 on the bottom surface, instead of bouncing off of a flat bottom surface and reflecting out of the cosmetic mesh 212. Additional details related to the various features of the fin element 202 that reduce reflected light to minimize visibility of the fin element 202 are discussed further below.

Figure 3:
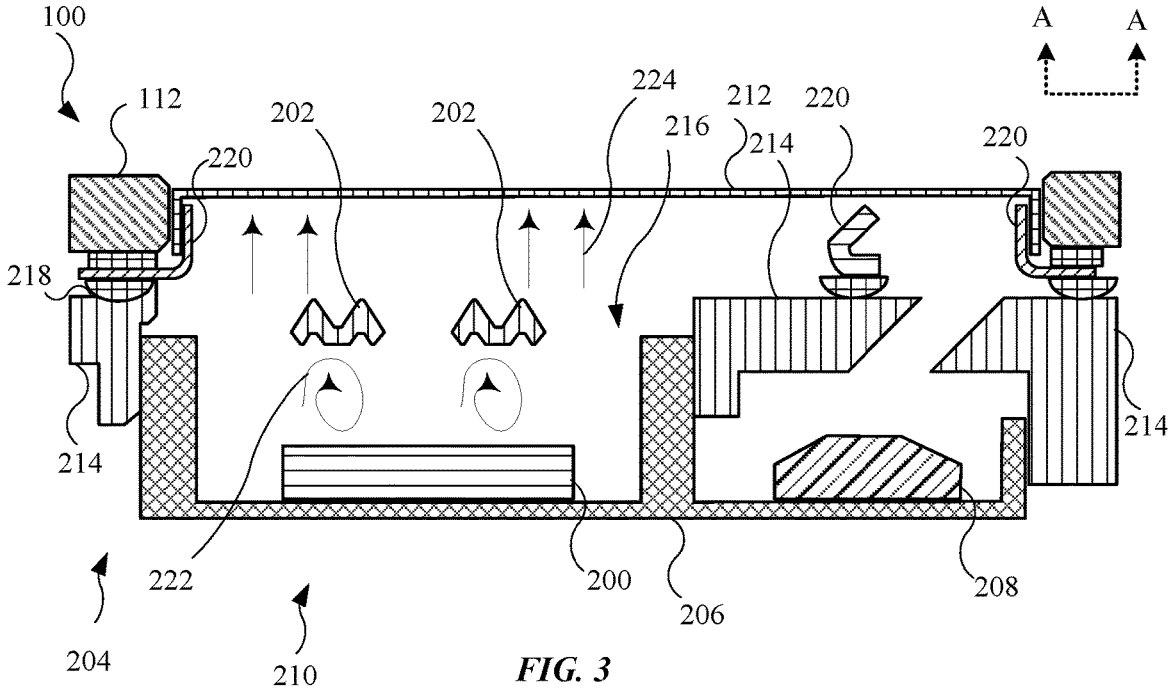

FIG. 3 illustrates a second example of two fin elements 202 disposed in a flow path of audible sound emitted from the audio module 200 in the internal volume 204. The second fin element 202 may further reduce the acoustic distortion 222 of the audible sound emitted by the audio module 200 prior to the audible sound leaving the cosmetic mesh 212. The audible sound may be re-laminarized (represented by straight arrows 224) as the audible sound passes around the fin elements 202 as a result of the fin elements disturbing the turbulent kinetic energy of the audible sound. In the depicted embodiment, the two fin elements 202 are included in the alignment ring 214 and span the bracket opening 216 or the alignment module opening 216. In some embodiments, the two fin elements 202 may be spaced apart in the bracket opening 216 or the alignment module opening 216 such that there is equidistance from each fin element 202 and the side walls of the alignment module opening 216 in the alignment ring 214. It should be understood that the two fin elements 202 may be disposed at different locations in the internal volume 204 such that the two fin elements 202 are in a flow path of audible sound emitted by the audio module 200 and reduce acoustic distortion 222.

Figure 4:
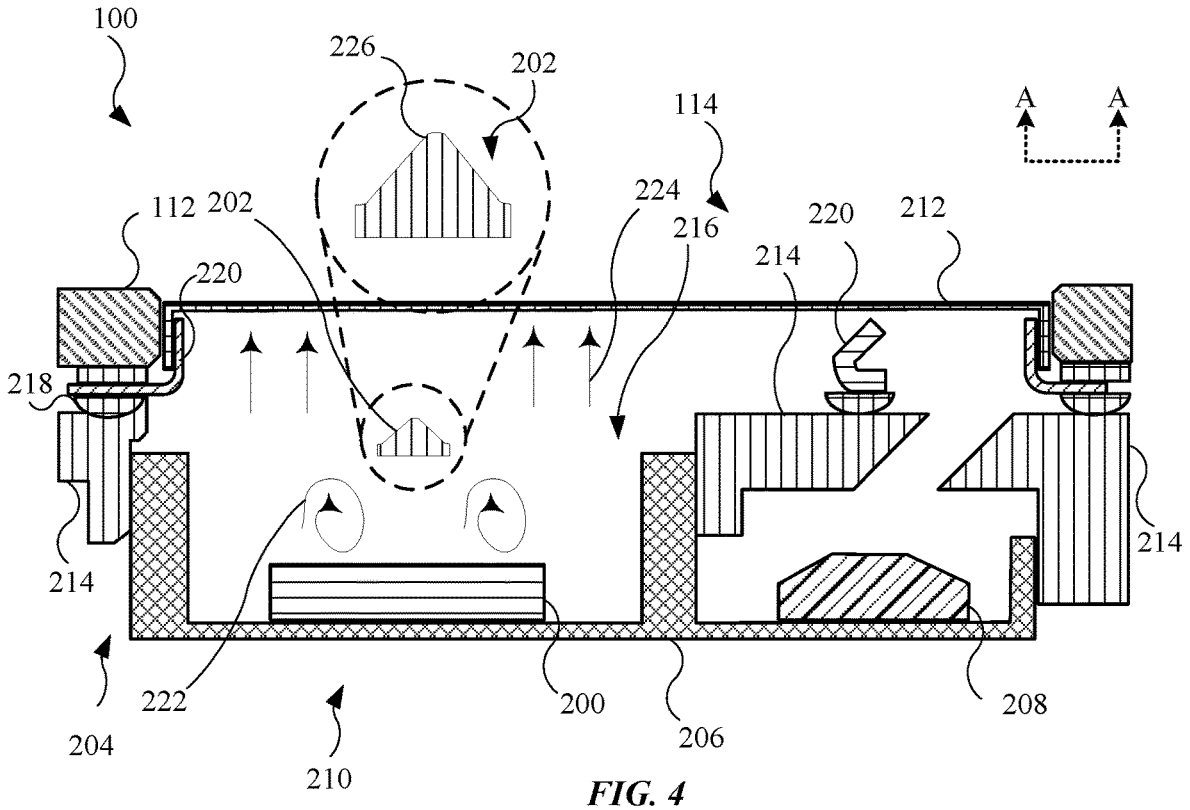

FIG. 4 illustrates a third example of a single fin element 202 disposed in a flow path of audible sound emitted from the audio module 200 in the internal volume 204. The fin element 202 depicted may also reduce acoustic distortion 222 of the audible sound emitted by the audio module 200. The audible sound may be re-laminarized (represented by straight arrows 224) as the audible sound passes around the single fin element 202 as a result of the fin element disturbing the turbulent kinetic energy of the audible sound. The description related to the fin element 202 illustrated in FIG. 2 may generally apply for the fin element 202 in FIG. 4. The difference between the fin element 202 in FIG. 2 and the fin element 202 in FIG. 4 is the shape of the fin element 202. As illustrated, and shown more clearly in the enlarged view, the fin element 202 in FIG. 4 includes a single peak 226 on a top surface of the fin element 202 that faces the cosmetic mesh 212 and the cover opening 114. Further, the bottom surface of the fin element 202 is flat, as opposed to including valleys. Although having a different shape, the fin element 202 may be capable of reducing the acoustic distortion 222 of the audible sound to provide higher quality audio.

Figure 5:
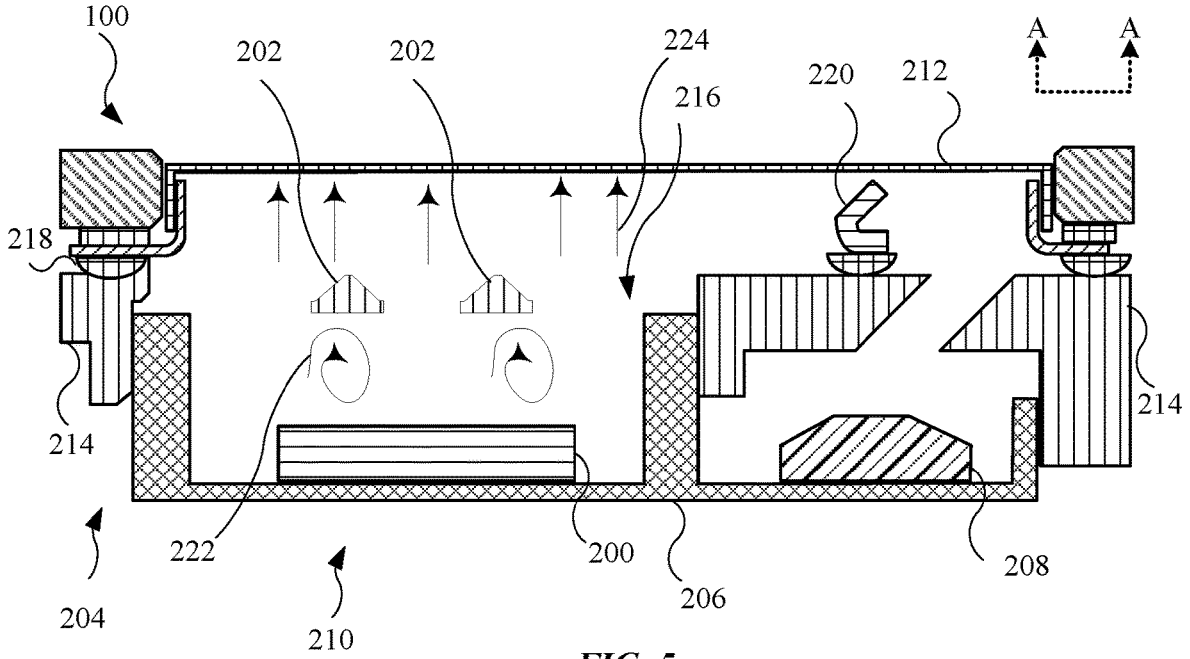

FIG. 5 illustrates a fourth example of two fin elements 202 disposed in a flow path of audible sound emitted from the audio module 200 in the internal volume 204. As described above, including a second fin element 202 in the flow path of the audible sound may further reduce the acoustic distortion 222 of the audible sound. The audible sound may be re-laminarized (represented by straight arrows 224) as the audible sound passes around the two single fin element 202 as a result of the two fin elements disturbing the turbulent kinetic energy of the audible sound. The difference between the two fin elements 202 of FIG. 5 and the two fin elements illustrated in FIG. 3 is the shape. Although having a different shape, the two fin elements 202 may be capable of reducing the acoustic distortion 222 of the audible sound to provide higher quality audio.

Figure 6:
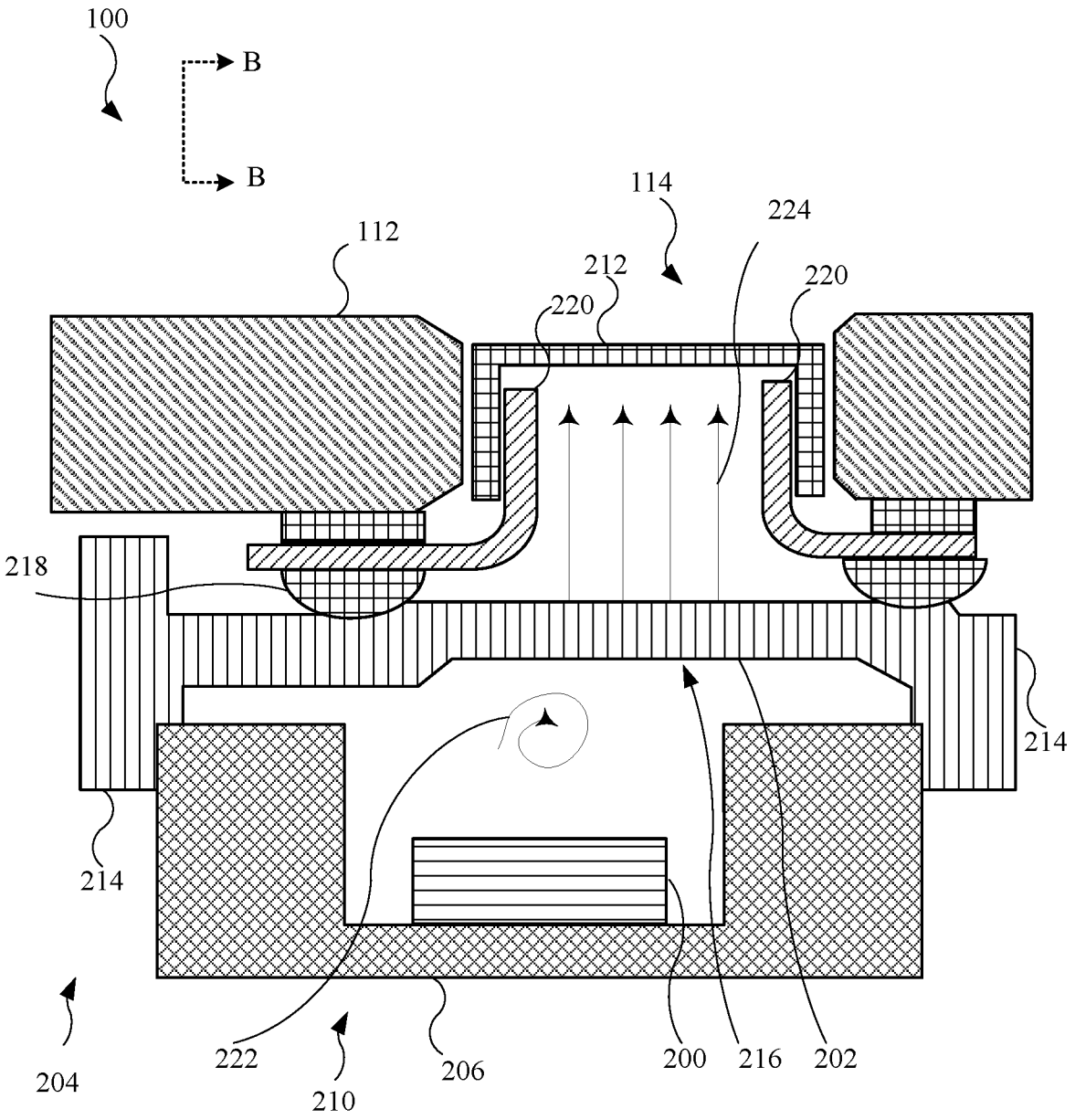
FIG. 6 illustrates another cross sectional view taken along line B-B of FIG. 1 of an example of the fin element disposed in the internal volume of the portable electronic device between the cover opening and the audio module, in accordance with some described embodiments.

FIG. 6 illustrates another cross sectional view taken along line B-B of FIG. 1 of an example of the fin element 202 disposed in the internal volume 204 of the portable electronic device 100 between the cover opening 114 and the audio module 200, in accordance with some described embodiments. In the illustrated embodiment shown in the cross sectional view taken along line B-B, the fin element 202 is illustrated as spanning the bracket opening 216 or the alignment module opening 216. The fin element 202 may be rigidly attached to the alignment ring 214 by being included in a mold of the alignment ring 214 or welded to the side walls of the bracket opening 216 or the alignment module opening 216. The fin element 202 is disposed in the flow path of audible sound emitted from the audio module 200 and reduces acoustic distortion 222 by re-laminarizing the audible sound (straight arrows 224). The description of the fin element 202 with reference to FIG. 2 above may apply to the fin element 202 illustrated in FIG. 6.

Figure 7:
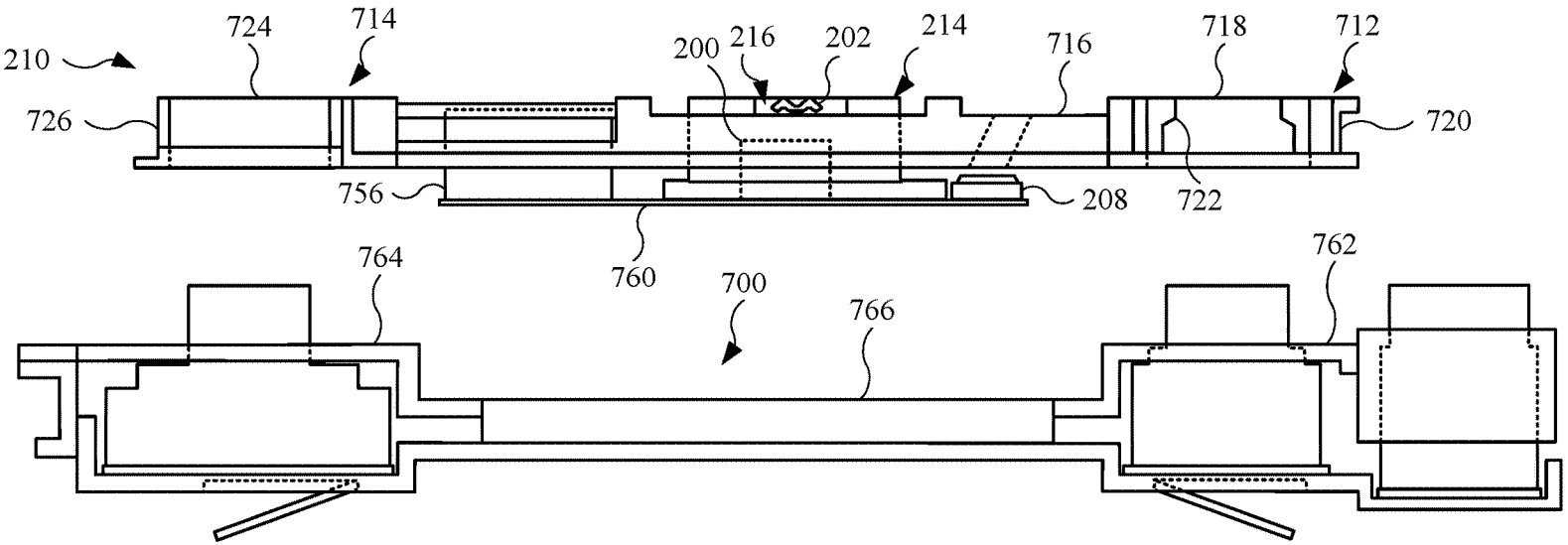
FIG. 7 illustrates a side view of an alignment module positioned over a bracket assembly and a fin element positioned in the alignment module, in accordance with some described embodiments.

FIG. 7 illustrates a side view of an alignment module 210 positioned over a bracket assembly 700 and a fin element 202 positioned in the alignment module 210, in accordance with some described embodiments. The bracket assembly 700 may include a vision system or any suitable system positioned in the bracket assembly 700. The alignment module 210 and the bracket assembly 700 may include any features described herein for an alignment module and a bracket assembly, respectively. As shown, the bracket assembly 700 includes a first section 762, a second section 764, and a third section 766 designed to interact with a first section 712, a second section 714, and a third section 716, respectively, of the alignment module 210. Also, the bracket assembly 700 is designed to carry various modules (e.g., camera modules, light emitting modules, etc.) of the vision system, for example.

The alignment module 210 may align and/or carry several components, such as the audio module 200, the microphone 208, a sensor (positioned behind the audio module 200), and a lighting element 756. The alignment module 210 may also align and/or carry a proximity sensor (not shown in FIG. 7). The alignment module 210 may be designed to position the aforementioned components at least partially in the third section 766 (or recessed section). Also, the audio module 200, the microphone 208, the sensor, and the lighting element may electrically couple to a flexible circuit 760 that can electrically couple to a processor (not shown in FIG. 7). The first section 712 of the alignment module 210 may further include an opening 718 designed to receive a portion of a module included in the bracket assembly 700. The first section 712 may further include an extended portion 720 having a contoured region 722 that defines a reduced diameter of the opening 718 of the first section 712 from a first end (such as the bottom end) to a second end (such as the top end) of the alignment module 210, with the extended portion 720 wrapping around a majority of the opening 718. The second section 714 may include an opening 724 designed to receive a portion of a second module included in the bracket assembly 700. The second section 714 of the alignment module 210 may include an extended portion 726 that forms a generally semicircular design such that a diameter of the opening 724 in the second section 714 remains generally constant.

The alignment module 210 may include an alignment ring 214 that includes side walls that define the bracket opening 216 or the alignment module opening 216. In some embodiments, the fin element 202 may be installed in the alignment module to span the bracket opening 216 or the alignment module opening 216. The fin element 202 may be located in a flow path of audible audio emitted from the audio module 200 (e.g., the fin element 202 is disposed between the audio module 200 and the cover opening of the portable electronic device). The fin element 202 may be positioned to disrupt turbulent kinetic energy experienced by the audible sound to reduce acoustic distortion by re-laminarizing the flow of the audible sound. The re-laminarized audible sound may be emitted the cosmetic mesh covering the cover opening of the cover (not shown in FIG. 7). Further, a top surface of the fin element 202 that faces the cosmetic mesh may include at least one visibility reducing feature that reduces light reflected off of the fin element 202. Reducing the light reflected off of the fin element 202 may reduce the visibility of the fin element 202 through the cosmetic mesh from a perspective external to the electronic device.

During an assembly operation of an electronic device (not shown in FIG. 7), the alignment module 210, secured with a cover (not shown in FIG. 7), is lowered down toward the vision system and the bracket assembly 700. While the cover is lowered, the alignment module 210 may contact the portion of a module in the bracket assembly 700, as an example, and apply a force to the module that causes the bracket assembly 700, along with the components of the vision system, to shift to a desired location in the electronic device.

Figure 8:
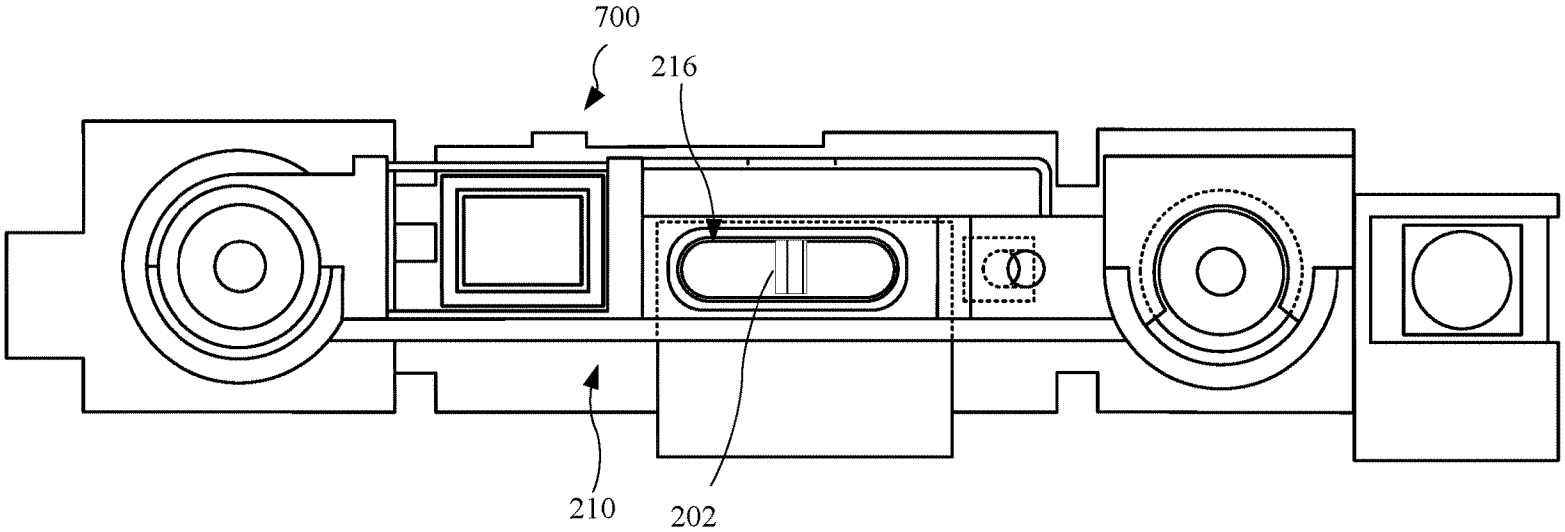
FIG. 8 illustrates a top view of the alignment module and the bracket assembly shown in FIG. 7, further showing the fin element, in accordance with some described embodiments.

FIG. 8 illustrates a top view of the alignment module 210 and the bracket assembly 700 shown in FIG. 7, further showing the fin element 202, in accordance with some described embodiments. As shown, the alignment module 210 is positioned over and onto the bracket assembly 700. When the bracket assembly 700 is assembled with the alignment module 210, the bracket assembly 700 may include the fin element 202 that may be disposed in the alignment module 210. As illustrated, the fin element 202 spans the bracket opening 216 or the alignment module opening 216. In some embodiments, the fin element 202 may be centered in the bracket opening of the alignment module opening 216. In other embodiments, the fin element 202 may be displaced relative to the center of the bracket opening 216 or the alignment module opening 216. In some embodiments the fin element 202 may be placed in any suitable location in the flow path of audible sound emitted from the audio module 200 in the internal volume. The bracket opening 216 or the alignment module opening 216 may be aligned with the cover opening of the cover to enable porting of the audible sound emitted by the audio module out of the portable electronic device.

Figure 9:
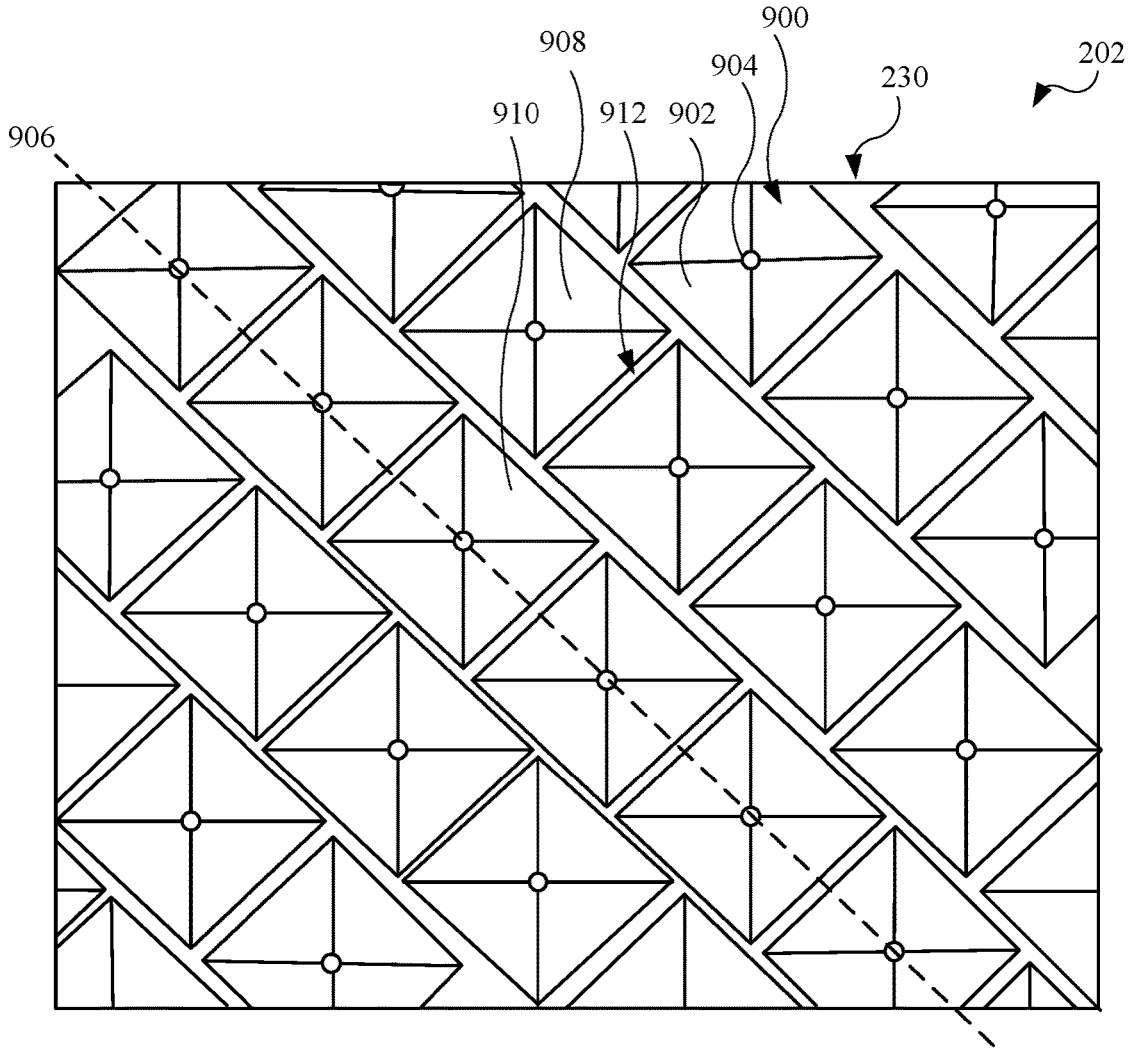
FIG. 9 illustrates a top view of a top surface of the fin element, and additional features, in accordance with some described embodiments.

FIG. 9 illustrates a top view of a top surface 230 of the fin element 202, and additional features, in accordance with some described embodiments. In some instances, adding an additional section, such as the fin element 202, to the alignment ring disposed in the internal volume below the cosmetic mesh, the top surface 230 of the additional section may become visible in certain lighting conditions due to different types of light reflections. Accordingly, in some embodiments, one or more features may be included in the top surface 230 to reduce the light reflections and the visibility of the top surface 230.

The different types of light reflections may include retro-reflection, direct reflection, and total internal reflection. Retro-reflection may refer to light that bounces off slopes of a ridged structure. For example, when the top surface 230 includes peaks or ridges having slopes and the slopes face one another, light may enter the cosmetic mesh, bounce off of one slope of a peak onto another slop of another peak that is aligned with the peak, and is reflected back out of the cosmetic mesh. The retro-reflections off neighboring ridges may cause axial brightness. Retro-reflections may cause the top surface 230 to be visible through the cosmetic mesh.

To reduce the retro-reflections, a feature, such as a three-dimensional offset pyramid geometry, may be included in the top surface 230 of the fin element 202. As illustrated, numerous pyramids 900 may be provided on the top surface 230, each pyramid 900 includes four slopes or faces 902 and a peak 904. The faces 902 may be characterized as triangle shapes. The pyramids 900 may be arranged in rows 906 in an offset manner such that a majority of the slopes 902 of the pyramids 900 in a row do not directly face another slope of a pyramid 900 in another row 906. For example, slope 902 of one pyramid 900 does not directly face slope 908 of another pyramid 900. Instead, slope 902 is aligned with slope 910 of a pyramid 900 that is two rows 906 away. As such, a channel 912 is provided between the slope 902 and the slope 910 such that when light bounces off slope 902, the light travels through the channel 912 and may dissipate due to the length of travel in the channel 910. Since the pyramids 900 in a line in each row, each row may include repeated triangle shapes. Further, the peaks 904 of the pyramids may represent numerous discrete dots so light reflections off of the peaks 904 is blurred and not as noticeable as light reflecting off of two-dimensional ridge geometries. The offset pyramid geometry may reduce total retro-reflective area and may have an effect of going from high-resolution to low-resolution by blending in dark areas.

Direct reflections may refer to light that enters the cosmetic mesh in a direction, hits the top surface 230 of the fin element 202, and reflects back out of the cosmetic mesh in the same direction in which the light entered. Direction reflections off peaks and valleys may cause axial and off-axis brightness. Direct reflections may also cause the top surface 230 to be visible through the cosmetic mesh. The direct reflections may occur when light directly strikes a peak 904 and/or a valley (e.g., channel 912).

To reduce the direct reflections, a feature, such as laser-etched peaks 904 and valleys (e.g., channel 912) of the offset pyramid geometry, may be included in the top surface 230 of the fin element 202. A laser-etched tool may be used to reduce the radii of the peaks 904 and valleys, thereby reducing the surface areas of flat portions of the peaks 904 and valleys. In some embodiments, the radii may be reduce to a range of approximately 10 micrometers to 30 micrometers (e.g., approximately 20 micrometers). By reducing the radii, direct reflections may occur less often due to the smaller surface area of the peaks and valleys of the offset pyramid geometry of the top surface 230.

Total internal reflection may refer to light that enters the material (e.g., polycarbonate) of the fin element 202, reflects at certain angles while entering the material and while moving in the material, and reflects out of the material at a different direction than the direction the light arrived at the top surface 230. In other words, the light may enter the material, transfer laterally, and exit back out of the material at a different area apex of the top surface 230. Total internal reflections can cause thin sections of the material to illuminate. The light reflected back out of the cosmetic mesh due to the total internal reflection may cause the top surface 230 to be visible through the cosmetic mesh.

Figure 10:
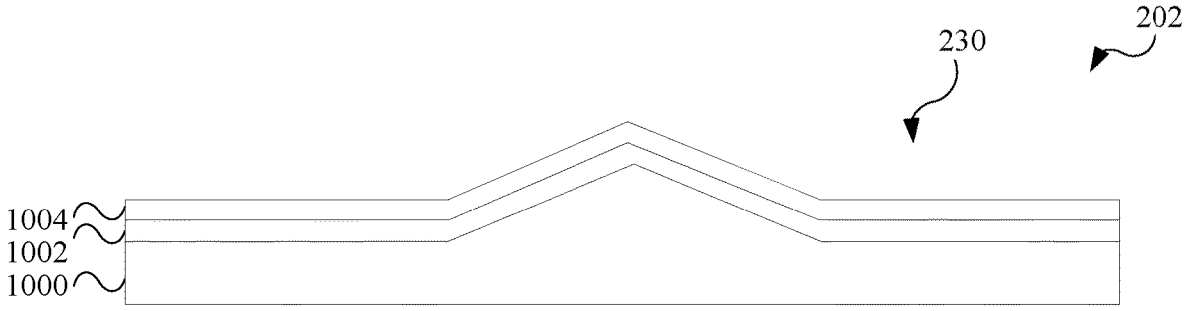
FIG. 10 illustrates a side view of the top surface of the fin element shown in FIG. 9, in accordance with some described embodiments.

To reduce total internal reflections, a feature, such as dark ink coloring and/or polyurethane coating, may be included in the top surface 230 of the fin element 202. FIG. 10 illustrates a side view of the top surface 230 of the fin element 202 shown in FIG. 9, in accordance with some described embodiments. The top surface 230 may be formed with substrate 1000, which may be a polycarbonate, metal, etc. Dark ink coloring 1002 may be applied to a surface of the substrate 1000 to darken the surface. Polyurethane coating 1004 may be applied to the dark ink coloring 1002 to provide a matte finish. The dark ink coloring 1002 and/or the polyurethane coating 1004 may reduce the total internal reflections of the top surface 230.

In some embodiments, a feature, such as laser markings, may be included in the top surface 230 of the fin element 202. The laser markings may be applied in combination with the dark ink coloring and/or polyurethane coating or may be used independently. The laser markings may darken the top surface 230 and roughens surface texture. The laser markings may burn and melt the substrate 1000 to darken its color without making the surface shiny. The laser markings may reduce the total internal reflections of the top surface 230.

In some embodiments, the various features described above may be used in any suitable combination to reduce retro-reflections, direct reflections, and/or total internal reflections of light striking the top surface 230 of the fin element 202. Further, additional features may be included in the top surface 230 to reduce visibility. For example, repeated triangle shape with laser roughening and darkening reflects light away from the user to make fin element 202 cosmetically acceptable. As a result of implementing one or more of the features, visibility of the top surface 230 of the fin element 202 through the cosmetic mesh may be reduced from a viewpoint external to the portable electronic device, thereby providing an enhanced look of the portable electronic device.

Figure 11:
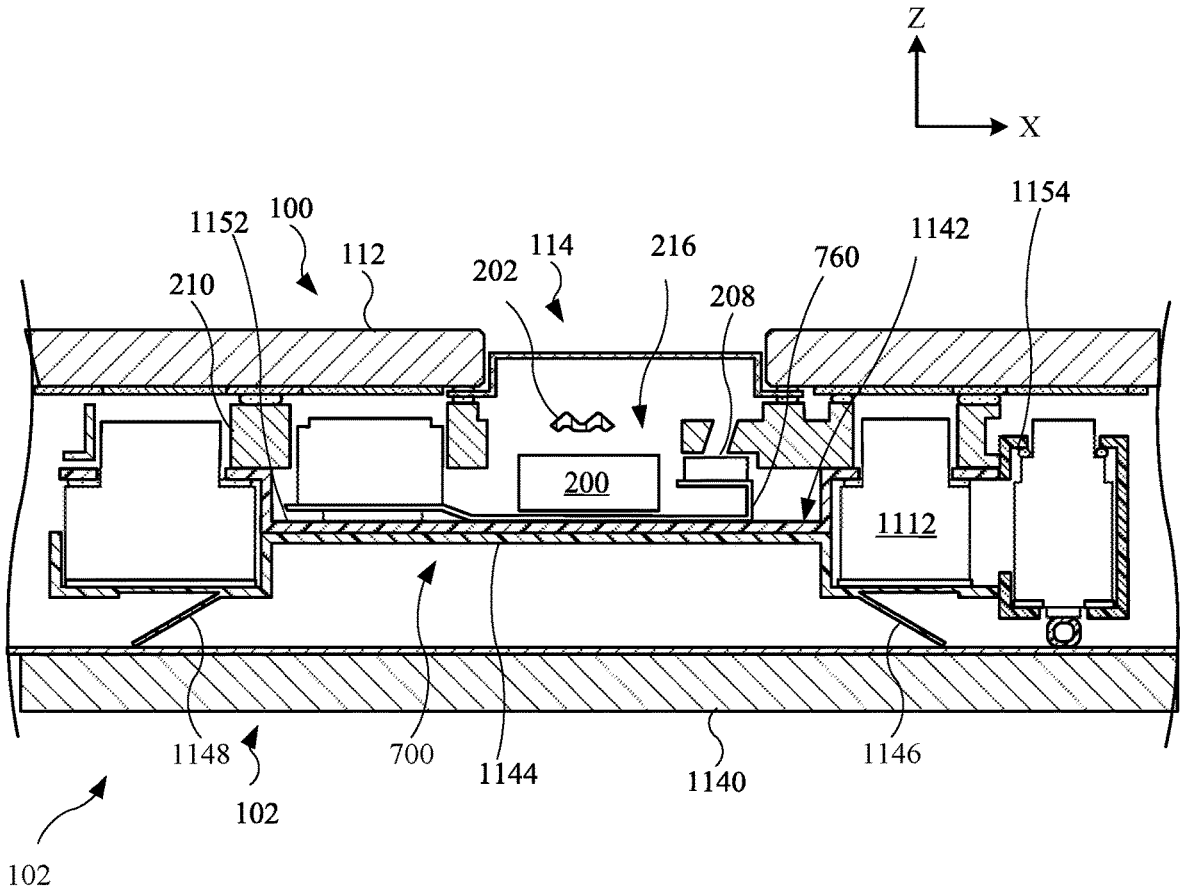
FIG. 11 illustrates a cross sectional view partially showing the electronic device shown in FIG. 1, showing the bracket assembly and the alignment module secured together.

FIG. 11 illustrates a cross sectional view partially showing the electronic device 100 shown in FIG. 1, showing the bracket assembly 700 and the alignment module 210 secured together, in accordance with some described embodiments. The electronic device 100 may include a circuit 760 that is electrically and mechanically coupled to the audio module 200, the microphone 208, and/or other components (e.g., a lighting element, a sensor). The circuit 760 may include a flexible circuit that is electrically and mechanically connected to a circuit board, thereby placing the audio module 200, the microphone 208, and/or other components in communication with the circuit board. Also, the alignment module 210 is adhesively secured with the cover 112. The alignment module 210 is aligned with the cover 112 such that when the audio module 200 is positioned in the alignment module opening 216 or the bracket opening 216, the audio module 200 is aligned with the cover opening 114 of the cover 112. Also, the alignment module 210 including the fin element 202 may be aligned with the cover 112 such that the fin element 202 is disposed between the audio module 200 and the cover opening 114. The fin element 202 may disrupt kinetic turbulent energy experienced by the audible sound to re-laminarize the audible sound prior to the audible sound exiting the cover opening 114. Further, the microphone 208 may be aligned with a diagonal opening (not labeled) of the alignment module 210, and at least partially aligned with the cover opening 114.

The bracket assembly 700 may include a first bracket 1142 and a second bracket 1144 secured with the first bracket 1142 to hold various modules (e.g., camera module, light module) of the vision system. The first bracket 1242 may include a multi-piece assembly. In this regard, the first bracket 1142 may include a first bracket part 1152 and a second bracket part 1154 secured with the first bracket part 1152. The second bracket part 1154 may be referred to as a module carrier that holds a module. The first bracket part 1152 may attach to the second bracket 1144 and the second bracket part 1154 by welding, as an example, thereby electrically coupling the brackets and the parts together. Other attachment methods that electrically couple the brackets and parts together are possible. The second bracket 1144 may include a first spring element 1146 and a second spring element 1148 that are used to support the bracket assembly 700 and the vision system.

The bottom wall 1140 may include a transparent material, such as glass or the like. In this regard, the bottom wall 1140 may include a material that is different from the side wall components shown in FIG. 1. However, in some embodiments (not shown), the bottom wall 1140 is formed from a metal and the side wall components (also formed from the metal) are integrally formed from the bottom wall 1140. Although not shown, the bottom wall 1140 may include a mask that provides an opaque material across a major surface of the bottom wall 1140.

When the electronic device 100 is being assembled, a module included in the bracket assembly 700 may engage the alignment module 210. The alignment module 210 may be secured to the cover 112 via an adhesive. The cover 112 may move in a direction toward the enclosure 102 in order to secure the cover 112 to the enclosure 102. As the cover 112 is lowered, the alignment module 210 may engage a module 1112 of the vision system. The force provided by the alignment module 210 to the module 1112 (by way of the cover 112 moving toward the enclosure 102) causes the module 1112 to shift in the x-direction, which in turn causes the bracket assembly 700 and the remaining modules to shift along the X-axis (in the "negative" direction). The shifting, or movement, of the modules causes the modules in the bracket assembly 700 to align in the electronic device 100 in a desired manner.

Figure 12:
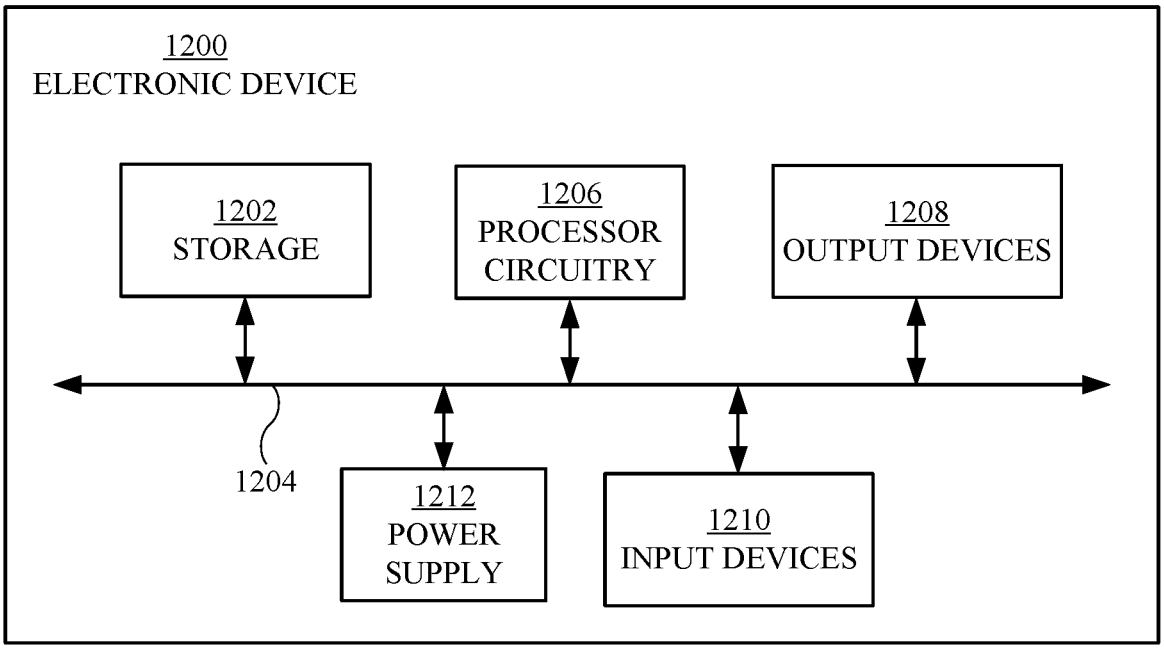
FIG. 12 illustrates a schematic diagram of an electronic device, in accordance with some described embodiments.

FIG. 12 illustrates a schematic diagram of an electronic device 1200. The electronic device 1200 may be representative of other embodiments of electronic devices described herein. The electronic device 1200 may include storage 1202. The storage 1202 may include one or more different types of storage such as hard disk drive storage, nonvolatile memory (such as flash memory or other electrically-programmable read-only memory), volatile memory (such as battery-based static or dynamic random-access memory).

The electronic device 1200 may include processor circuitry 1206 having one or more processors that communicate with several peripheral devices via a bus system 1204. The processor circuitry 1206 may be used to control the operation of the electronic device 1200, and may include a processor (such as a microprocessor) and other suitable integrated circuits. In some embodiments, the processor circuitry 1206 and the storage 1202 run software on the electronic device 1200. For example, the software may include object recognition software. In this regard, the electronic device 1200 may include output devices 1208 and input devices 1210 that supply data to the electronic device 1200, and also allow data to be provided from the electronic device 1200 to external devices. The output devices 1208 may include an audio module that is aligned with a cover opening of the electronic device 1200. The audio module is capable of emitting an audible sound. The audible sound may experience acoustic distortion based on structures resonating within a flow path of the audible sound. A fin element may be disposed within the flow path of the audible sound between the audio module and the cover opening. The fin element may re-laminarize the audible sound by disrupting the turbulent kinetic energy causing the acoustic distortion. Further, the fin element may include one or more features on a top surface facing the covering opening to reduce light reflecting off of the top surface to reduce visibility of the fin element through the cover opening. The output devices 1208 may further include a lighting element used during low-light (dim) applications. Additionally, the output devices 1208 may include a display layer (associated with a display assembly).

The input devices 1210 may include multiple camera modules. Additionally, the input devices 1210 may include buttons, switches, touch input and force touch layers (associated with a display assembly). Also, the electronic device 1200 may include a power supply 1212 (such as a battery) that provides electrical energy to the storage 1202, the processor circuitry 1206, the output devices 1208, and the input devices 1210.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data, which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A portable electronic device, comprising:

a housing that at least partially defines an internal volume;

a cover secured to the housing at least partially enclosing the internal volume, the cover defining a cover opening capable of passing an audible sound provided by an audio module along an audible sound path; and a bracket assembly positioned in the internal volume defining a bracket opening that is positioned between the audio module and the cover opening, the bracket assembly comprising a fin element that spans the bracket opening, the fin element at least partially positioned in the audible sound path and having a triangular cross section.

2. The portable electronic device as recited in claim 1, wherein the fin element is capable of reducing an acoustic distortion of the audible sound at the cover opening.

3. The portable electronic device as recited in claim 1, wherein the fin element is located at a central portion of the bracket opening.

4. The portable electronic device as recited in claim 3, wherein the first and second fin elements are spaced apart within the bracket opening.

5. The portable electronic device as recited in claim 3, wherein the first and second fin elements are spaced equidistant from sidewalls defining the bracket opening.

6. The portable electronic device as recited in claim 1, wherein the fin element is a first fin element, and wherein the bracket assembly further comprises a second fin element at least partially positioned within the audible sound path.

7. The portable electronic device as recited in claim 1, wherein the fin element has a chevron like cross section.

8. The portable electronic device as recited in claim 7, wherein the pyramid geometry comprises peaks and valleys.

9. The portable electronic device as recited in claim 7, wherein the top surface of the fin element comprises laser markings.

10. The portable electronic device as recited in claim 1, wherein a top surface of the fin element facing the cover opening has a pyramid geometry.

11. The portable electronic device as recited in claim 1, wherein a top surface of the fin element facing the cover opening is defined by at least one peak and a bottom surface of the fin element facing the audio module is defined by at least one valley.

12. The portable electronic device as recited in claim 1, further comprising a cosmetic mesh that covers the cover opening, wherein a surface of the fin element facing the cosmetic mesh comprises at least one feature comprising laser markings, dark ink coloring, a polyurethane coating, or an offset pyramid geometry.

13. A portable electronic device, comprising:

an enclosure comprising a bottom wall and side walls;

a cover secured to the enclosure, wherein the bottom wall, the side walls, and the cover at least partially define an internal volume, the cover defining a cover opening;

an audio module disposed in the internal volume and capable of providing an audio energy flow passing from the audio module to the cover opening along a flow path; and an acoustic element at least partially disposed in the flow path, the acoustic element comprising a peak that defines a surface facing the cover opening.

14. The portable electronic device as recited in claim 13, wherein the acoustic element spans a portion of a bracket opening defined by a bracket disposed in the internal volume and through which the flow path travels.

15. The portable electronic device as recited in claim 13, further comprising a second acoustic element disposed in flow path.

16. The portable electronic device as recited in claim 13, wherein the acoustic element comprises an offset pyramid geometry that defines a surface facing the cover opening.

17. A portable electronic device, comprising:

an enclosure comprising side walls, a bottom wall, and a cover defining a cover opening;

an audio module disposed in an internal volume defined by the enclosure, the audio module capable of producing audible sound along a flow path through the cover opening; and fin elements disposed in the enclosure at least partially located in the flow path, the fin elements comprising triangular features defining surfaces facing the cover opening.

18. The portable electronic device as recited in claim 17, wherein the fin elements are capable of reducing an acoustic distortion of the audible sound at the cover opening.

19. The portable electronic device as recited in claim 17, wherein the fin elements each comprise repeated triangle shape objects with laser roughening and darkening.

20. The portable electronic device of claim 17, wherein the fin elements each have a same shape and are arranged equidistant from each other in the enclosure.

* * * * *